US006422503B1

(12) United States Patent
Hoo Kong

(10) Patent No.: US 6,422,503 B1
(45) Date of Patent: Jul. 23, 2002

(54) TOILET PAPER ROLL DISPENSER

(76) Inventor: Michele Renee Hoo Kong, 125 Cliff wood Road, Toronto, Ontario (CA), M2H 2E3

( * ) Notice: Subject to any disclaimer, the term of this patent is extended or adjusted under 35 U.S.C. 154(b) by 0 days.

(21) Appl. No.: 09/866,415

(22) Filed: May 29, 2001

(51) Int. Cl.[7] ..... B65H 19/00

(52) U.S. Cl. ..... 242/559.4; 242/597.7; 242/560.1

(58) Field of Search ..... 242/559.3, 559.4, 242/560, 560.1, 560.2, 560.3, 597.7, 598.4, 592, 594, 594.3, 594.5, 594.6; 312/34.22; D6/518, 519, 520, 523, 515; 221/226, 233, 274, 194; 206/225, 391

(56) References Cited

U.S. PATENT DOCUMENTS

| | | | | | |
|---|---|---|---|---|---|
| 1,917,641 | A | * | 7/1933 | Fairchild | 242/560.3 |
| 3,295,900 | A | * | 1/1967 | Kendall | 242/559.4 |
| 3,642,170 | A | * | 2/1972 | Shelley | 221/226 |
| 4,177,958 | A | * | 12/1979 | Poole | 242/597.7 |
| 4,369,929 | A | * | 1/1983 | Cayer | 242/594.6 |
| 4,432,451 | A | * | 2/1984 | Hooser | 242/560.2 |
| 4,607,809 | A | * | 8/1986 | Sineni et al. | 242/560 |
| 5,048,720 | A | * | 9/1991 | Hoke | 221/274 |
| 5,887,818 | A | * | 3/1999 | Kelley | 242/559.3 |
| D430,984 | S | * | 9/2000 | Camarena | D6/520 |
| 6,290,169 | B1 | * | 9/2001 | Hartley | 242/597.7 |
| 6,318,821 | B1 | * | 11/2001 | Martin et al. | 242/559.4 |

* cited by examiner

*Primary Examiner*—William A. Rivera
(74) *Attorney, Agent, or Firm*—Swabey Ogilvy Renault; Guy J. Houle

(57) ABSTRACT

A dispenser for toilet paper rolls each having a hollow tube core section on which paper is rolled, comprises an upstanding elongated container defined by a peripheral wall and a base portion at a bottom end thereof. A removable cover portion is at an open top end of the elongated container. The peripheral wall has an aperture defined therein. The elongated container comprises a circular shaft extending axially therein adapted for receiving paper rolls stacked one on another such that the paper rolls can rotate thereabout. An abutment plate is disposed in the elongated container on a biasing spring and is free to translate longitudinally on the circular shaft in the elongated container. The abutment plate is adapted for receiving a bottommost paper roll of the stacked paper rolls thereon. The biasing spring is calibrated to support the stack of paper rolls through the abutment plate such as to align an uppermost paper roll opposite the aperture in the peripheral wall, wherein the uppermost paper roll is in a dispensing position. The biasing spring gradually moves the abutment plate upward as paper is dispensed from the uppermost paper roll and weight of the stacked paper rolls diminishes such that a subsequent paper roll gradually reaches the dispensing position.

12 Claims, 1 Drawing Sheet

TOILET PAPER ROLL DISPENSER

FIELD OF THE INVENTION

The present invention relates to a dispenser and, more particularly, to a toilet paper roll dispenser which facilitates the dispensing of two and more rolls.

BACKGROUND OF THE INVENTION

Toilet paper dispensers are usually found in the bathrooms of the typical home or in public restrooms. The known dispensers vary in size and model, but generally provide a configuration which allows for a paper roll to rotate about itself as paper is being dispensed therefrom. More elaborate models of dispensers have provided methods to store paper rolls. For instance, large families or frequently attended bathrooms may require such dispensers. These avoid the inconvenience of running out of toilet paper during use, and help reduce the manpower required to refill the dispensers.

U.S. Pat. No. 1,917,641, issued on Jul. 11, 1933 to Fairchild discloses a rack of cylindrical shape resting on a lateral surface thereof and enclosing toilet paper rolls. The toilet paper rolls are disposed around a shaft axially disposed in the rack, such as to rotate thereabout. A portion of the lateral surface of the cylindrical rack provides an opening for paper of an end paper roll to be dispensed therethrough, whereas one or more other toilet paper rolls are encaged therein. A cap is hinged to an edge of the lateral surface such as to cover an end of the cylindrical rack and to provide access to the interior of the rack. Once the end paper roll is used up, the hollow tube core section thereof may be removed by opening the cap, in which case the adjacent stored paper roll is pushed into a dispensing position by a spring-biased plate disposed inside the rack and connected to an opposed end thereof.

Although the above described patent provides the possibility to store rolls of toilet paper in a dispenser, manual intervention is still required in order to remove the core sections such that the stored toilet paper roll may reach a dispensing position. Although this is not an issue if the dispenser is used domestically, it does represent a disadvantage in the instances where the hinged cap is locked to the rack, as may be the case with dispensers used in public restrooms, wherein the cap is locked to prevent toilet paper theft. Furthermore, the above described dispenser is generally restricted to permanent wall mounting.

U.S. Pat. No. 3,245,626 issued on Apr. 12, 1966 to Casteel, discloses a toilet tissue dispenser having an upstanding paper roll container of rectangular cross-section having a dispensing head portion at a top end thereof. The toilet paper rolls are disposed one on another on their lateral surfaces and the bottommost roll lies on a moveable plate. The moveable plate is secured to a lifting mechanism having a lever portion which is disposed such as to be handled by an operator. The dispensing portion comprises moveable pivot portions which may be engaged on either sides of a hollow tube core section of a roll having reached the dispensing portion. Once the paper roll is used up, the pivot portions may be released such that the hollow tube core is ejected from the dispensing portion. Thereafter, the operator may pull up the lever to move the stack of paper rolls upwards, whereby a second paper roll is loaded in the dispensing portion.

Although the above described patent discloses a method for storing a great quantity of toilet paper rolls, manual intervention is still required in order to load paper rolls in the dispensing portion. For hygiene purposes, some people may be reluctant in handling the lever to load a toilet paper roll if the dispenser is part of a public restroom. Furthermore, some users of public restrooms may not be familiar with the loading method of such an apparatus, in which case periodic manual attendance is still required.

SUMMARY OF THE INVENTION

It is a feature of the present invention to provide a toilet paper dispenser which substantially overcomes the disadvantages of the prior art.

It is a further feature of the present invention to provide a toilet paper dispenser which is simple in use and inexpensive to produce.

BRIEF DESCRIPTION OF THE DRAWINGS

A preferred embodiment of the present invention will now be described in detail having reference to the accompanying drawings in which.

DESCRIPTION OF PREFERRED EMBODIMENTS

Figure 1:
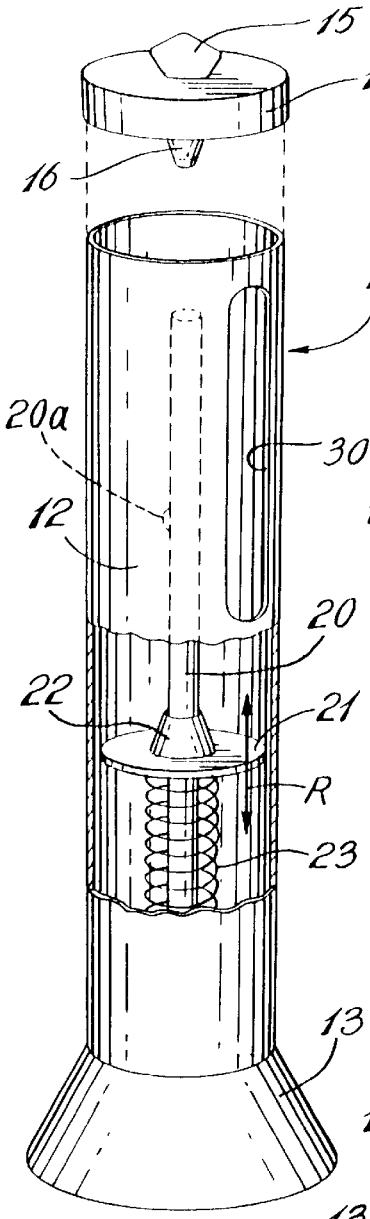
FIG. 1 is a perspective exploded view, partly fragmented, of a paper roll dispenser in accordance with the present invention.
Figure 2:
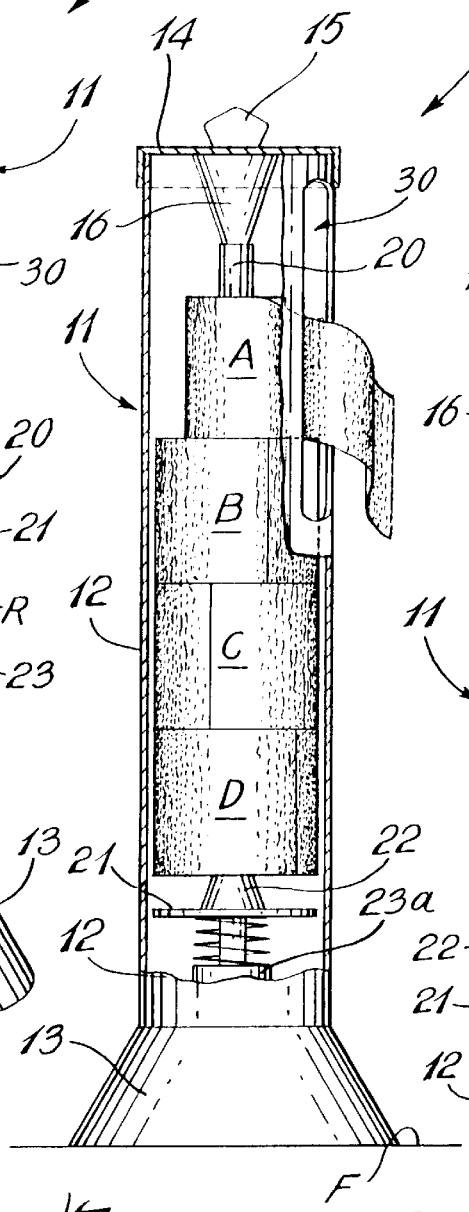
FIG. 2 is an elevation view, partly fragmented, of the paper roll dispenser loaded with toilet paper.

According to the drawings and, more particularly, to FIG. 1, a paper roll dispenser in accordance with the present invention is generally shown at 10. The paper roll dispenser 10 comprises a generally cylindrical container portion 11 having a lateral wall 12. The container portion 11 is secured to a downwardly flared base 13. The flared base 13 may enclose weights (not shown) in order to provide the paper roll dispenser 10 with stability when disposed on a floor (FIG. 2). An aperture 30 is formed in the lateral wall 12 of the container portion 11 and is generally adjacent a top end of the container portion 11.

A removable cap 14 is placed on a top end of the container portion 11. The removable cap 14 comprises a knob 15, concentrically secured to a top surface thereof, and an upwardly flared guide 16, projecting from a center of a bottom surface thereof.

An upstanding shaft 20 of circular cross-section extends from the flared base 13 to the top end of the cylindrical container portion 11, and is axially positioned with respect to the cylindrical container portion 11. As best seen in FIG. 2, a top end of the upstanding shaft 20 terminates opposite a bottom end of the flared guide 16 of the removable cap 14, when the removable cap 14 is mounted on the container portion 11. The removable cap 14 is shaped to snuggly fit on the container portion 11. It is pointed out that there are various methods for connecting the removable cap 14 to the container portion 11 (e.g. mating threading and tapping, snap-fit devices, etc.). It is observed that a locking mechanism may be provided although not shown, such as to grant access to the container portion 11 to maintenance staff, in the case of use in a public restroom.

Returning to FIG. 1, it can be seen that an annular disk 21 surrounds the shaft 20 such as to translate axially thereon as shown by arrow R. The annular disk 21 may have a downwardly flared guide 22 concentrically disposed on a top surface thereof for easing the dispensing of paper from a paper roll when disposed thereon. A biasing member, in this case a helical spring 23, extends between the flared base 13 and a bottom surface of the disk 21 to upwardly bias the disk 21. For instance, the helical spring may be supported on a top surface of the flared base 13. It has also been thought to provide an annular cup 23*a* projecting upwardly from the top surface of the flared base 13, and concentric with the shaft 20, for serving as a housing for the helical spring 23. Such a housing will extend the life of the helical spring 23. A stopper 20*a* may be secured to the shaft 20 to limit the stroke of the annular disk 21.

Referring now to FIG. 2, the paper roll dispenser 10 is shown enclosing paper rolls A, B, C and D. The paper rolls may be typical toilet paper rolls each having a hollow tube core section of cylindrical shape upon which toilet paper is rolled. The toilet paper rolls are inserted in the container portion 11 from the top end of thereof with the cap 14 removed and are disposed around the shaft 20 through their core sections. The toilet paper rolls may thus rotate about the shaft 20, and translate thereon. It is observed that the dispenser 10 is simply disposed on a floor F, although it could be permanently secured thereto in public restroom uses. This allows for the dispensers 10 used in households to be moved around.

The container portion 11 may be sized to accommodate various amounts of paper rolls. As illustrated in FIG. 2, the dispenser 10 encloses four paper rolls. When the rolls are received in the container portion 11, the bottom roll D will sit on either the annular disk 21 or on the flared guide 22 if same is provided on the annular disk 21, whereby in the latter case friction is reduced when paper is dispensed. The weight of the toilet paper rolls will compress the helical spring 23 such that the toilet paper roll A faces the aperture 30 in the lateral wall 12 of the container portion 11. The aperture 30 is sized (e.g. width of 2", height of 8") to accommodate the fingers (e.g. of a typical adult) therein in order to grab the free end sheet of paper from the toilet paper roll for the dispensing thereof.

Figure 3:
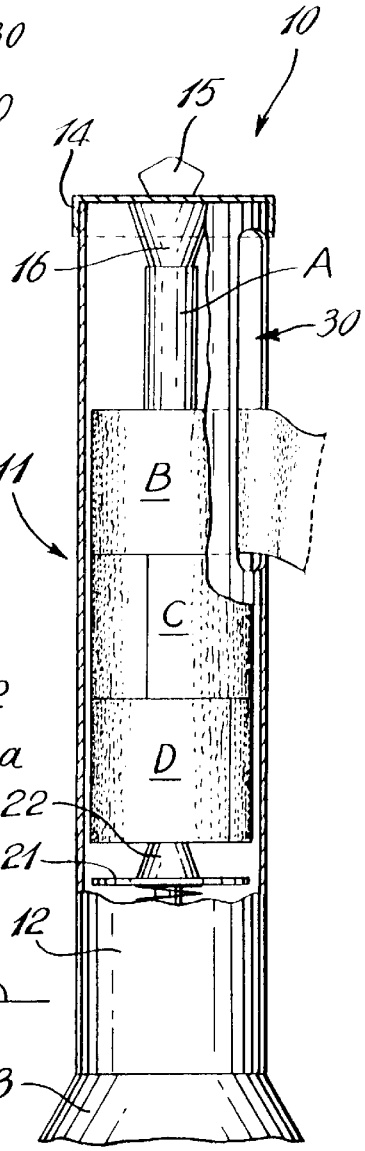
FIG. 3 is an elevation view, partly fragmented, of the paper roll dispenser of FIG. 2 having a used up roll of toilet paper.

As paper is being dispensed from the paper roll, the weight resting on the disk 21 will diminish, whereby it will move upward as it is biased by the helical spring 23. Therefore, as the paper is being dispensed from the top roll A, the disk 21, and the toilet paper rolls sitting thereon, will gradually move in an upward direction. The length of the aperture 30 is defined to accommodate this movement of the top roll A. As shown in FIG. 3, the core section of toilet paper roll A will eventually abut the upwardly flared guide 16, whereby rotation of the stack of toilet paper rolls is facilitated and at which point toilet paper roll B will be aligned with the aperture 30 such as to be dispensed therethrough. Although this is not the case in FIG. 3, it is noted that the aperture may be sized and positioned for the third roll C to be dispensed when the first roll A is abutting the flared portion 16 of the cap 14. On the other hand, the core section of the used up paper roll A may be discarded by removing the cap 14 from the container portion 11. It is also observed that the inside of the container portion 11 is partially visible from the aperture 30 such as to determine whether it needs to be refilled. It is pointed out that the dispenser 10 may be of rectangular cross-section such as to be embedded in a wall, such that the aperture 30 is the only visible portion of the dispenser 10. The dispenser 10 may be of various materials and colors, so as to suit the decoration of any household.

It is within the ambit of the present invention to cover any obvious modifications of the embodiments described herein, provided such modifications fall within the scope of the appended claims.

What is claimed is:

1. A dispenser for toilet paper rolls, each toilet paper roll having a hollow tube core section on which paper is rolled, comprising:

an upstanding elongated container defined by a peripheral wall and a base portion at a bottom end thereof, a removable cover portion at an open top end of said elongated container, said peripheral wall having an aperture defined therein;

said elongated container comprising a generally circular shaft extending axially therein and being adapted for receiving at least two paper rolls stacked one on another such that the paper rolls can rotate thereabout;

an abutment plate disposed in said elongated container on a biasing member and free to translate longitudinally on said circular shaft in said elongated container, said abutment plate being adapted for receiving a bottommost paper roll of the stacked paper rolls thereon;

said biasing member being calibrated to support the stack of paper rolls through said abutment plate such as to align an uppermost paper roll opposite said aperture in said peripheral wall, wherein said uppermost paper roll is in a dispensing position, said biasing member gradually moving said abutment plate upward as paper is dispensed from the uppermost paper roll and weight of the stacked paper rolls diminishes such that a subsequent paper roll gradually reaches said dispensing position.

2. The dispenser according to claim 1, wherein said biasing member is a helical spring.

3. The dispenser according to claim 2, wherein said helical spring is received in a housing when compressed, said housing being an annular cup extending from said base portion of said dispenser.

4. The dispenser according to claim 2, wherein said circular shaft comprises a stopper portion for limiting the longitudinal translation of said abutment plate.

5. The dispenser according to claim 1, wherein said abutment plate comprises a guide for facilitating the dispensing of the paper rolls.

6. The dispenser according to claim 5, wherein said guide is defined by a flared member.

7. The dispenser according to claim 1, wherein said removable cover portion comprises an upwardly flared guide on a bottom surface thereof for facilitating rotation of the uppermost paper roll when same abuts said removable cover portion.

8. The dispenser according to claim 1, wherein height of said aperture is configured such as to accommodate gradual upward motion of the uppermost paper roll and a subsequent paper roll reaching said dispensing position.

9. The dispenser according to claim 8, wherein width of said aperture is configured such as to accommodate fingers of an typical adult hand.

10. The dispenser according to claim 1, wherein said base portion defines a downwardly flared shape for adding stability to said dispenser.

11. The dispenser according to claim 1, wherein said base portion comprises weights for adding stability to said dispenser.

12. The dispenser according to claim 1, wherein said container is adapted for receiving four paper rolls.

* * * * *